US006409426B1

(12) United States Patent
MacLellan

(10) Patent No.: US 6,409,426 B1
(45) Date of Patent: Jun. 25, 2002

(54) VIBRATORY TAMPING TOOL

(76) Inventor: Kevin MacLellan, 529 Maple Hill Rd., Guilford, CT (US) 06437

( * ) Notice: Subject to any disclaimer, the term of this patent is extended or adjusted under 35 U.S.C. 154(b) by 0 days.

(21) Appl. No.: 09/510,511

(22) Filed: Feb. 22, 2000

(51) Int. Cl.[7] ..... E01C 19/32
(52) U.S. Cl. ..... 404/133.1; 404/133.05
(58) Field of Search ..... 404/97, 133.05, 404/133.1, 114

(56) References Cited

U.S. PATENT DOCUMENTS

| | | | | |
|---|---|---|---|---|
| 3,672,639 A | | 6/1972 | Wadensten | |
| 3,790,137 A | | 2/1974 | Wadensten | |
| 3,870,282 A | | 3/1975 | Wadensten | |
| 3,932,057 A | | 1/1976 | Wadensten | |
| 3,938,905 A | | 2/1976 | Wadensten | |
| 3,945,246 A | | 3/1976 | Wadensten | |
| 4,042,102 A | | 8/1977 | Wadensten | |
| 4,113,403 A | | 9/1978 | Tertinek et al. | |
| 4,156,576 A | | 5/1979 | Clavel et al. | |
| 4,170,427 A | | 10/1979 | Grane | |
| 4,186,197 A | | 1/1980 | Tetsuo | |
| 4,280,616 A | | 7/1981 | Wadensten | |
| 4,343,568 A | | 8/1982 | Kaltenegger | |
| 4,389,120 A | | 6/1983 | Wadensten | |
| 4,407,403 A | | 10/1983 | Wadensten | |
| 4,425,813 A | | 1/1984 | Wadensten | |
| 4,583,414 A | | 4/1986 | Wadensten | |
| 4,590,814 A | | 5/1986 | Wadensten | |
| 4,607,980 A | | 8/1986 | Shilkov et al. | |
| 4,643,611 A | | 2/1987 | Pilachowski | |
| 4,650,366 A | * | 3/1987 | Morrison | 404/114 |
| 4,653,927 A | | 3/1987 | Wadensten | |
| 4,911,575 A | * | 3/1990 | Tidwell | 404/97 |
| 5,115,536 A | * | 5/1992 | Jarvis | 15/235.8 |
| 5,261,762 A | * | 11/1993 | Yamaguchi | 404/133.05 |
| 5,340,233 A | | 8/1994 | Motl | |
| 5,439,314 A | | 8/1995 | Wadensten | |
| 5,645,370 A | | 7/1997 | Zürbes et al. | |
| 5,934,825 A | * | 8/1999 | Waldenberger | 404/133.1 |

FOREIGN PATENT DOCUMENTS

| | | |
|---|---|---|
| DE | 21 55 687 | 5/1973 |
| DE | 19 16 396 | 6/1978 |
| DE | 28 15 723 | 10/1978 |

* cited by examiner

*Primary Examiner*—Robert E. Pezzuto
*Assistant Examiner*—Raymond W. Addie
(74) *Attorney, Agent, or Firm*—Richard C. Litman

(57) ABSTRACT

A vibratory tamping tool which is shaped for easy maneuvering and tilting so as to allow the tamping and shaping of surfaces which are sloped relative to the horizontal. The tool has a tamping surface which is longer than it is wide, and the tools handle bar is oriented parallel to the length of the tamping surface. A motor and vibratory mechanism are supported on a platform which spaced apart from the tamping surface. The platform is supported above the tamping surface by a web plate extending from the plate which forms the tamping surface to the platform supporting the motor and vibratory mechanism.

5 Claims, 5 Drawing Sheets

VIBRATORY TAMPING TOOL

BACKGROUND OF THE INVENTION

1. Field of the Invention

The present invention relates to a vibratory tool for compacting concrete or asphalt.

2. Description of the Related Art

Poured concrete or asphalt driveways are usually compacted using heavy rollers. This process, however, can lead to driveway edges that are irregular and which easily crumble. Most hand or power tampers are designed for tamping horizontal surfaces and are not suited for tamping the edges of poured or deposited driveways. Examples of vibratory tampers which are not particularly suited for tamping sloping surfaces are shown among the references cited below.

U.S. Pat. No. 5,645,370, issued to Arno Zurbes et al. on Jul. 8, 1997; U.S. Pat. No. 5,439,314, issued to Theodore S. Wadensten on Aug. 8, 1995; U.S. Pat. No. 5,340,233, issued to Robert M. Motl on Aug. 23, 1994; U.S. Pat. No. 4,643,611, issued to Martin Pilachowski on Feb. 17, 1987; U.S. Pat. No. 4,607,980, issued to Vladimir A. Shilkov et al. on Aug. 26, 1986; U.S. Pat. No. 4,343,568, issued to Benno Kaltenegger on Aug. 10, 1982; U.S. Pat. No. 4,186,197, issued to Susumu Tetsuo on Jan. 29, 1980; U.S. Pat. No. 4,170,427, issued to Gunnar Grane on Oct. 9, 1979; U.S. Pat. No. 4,156,576, issued to Alain Clavel et al. on May 29, 1979; U.S. Pat. No. 4,113,403, issued to Christian T. Tertinek et al. on Sep. 12, 1978; German Unexamined Patent Application Number 28 15 723, by Gunnar Grane, published on Oct. 19, 1978; German examined Patent Application Number 19 16 396, by Heinrich Treude, published on Jun. 15, 1978; and German Unexamined Patent Application Number 21 55 687, by Wacker Werke KG, published on May 17, 1973, all show powered vibratory tampers or compactors.

A vibratory edger made by VIBCO industrial vibration products is shown on VIBCO's internet site at www.vibco-.com. The posting date of this site on the internet is not known. VIBCO's vibratory edger is designed such that a portion of its tamping surface lies horizontally on the top surface of an asphalt driveway while another portion of the tamping surface is at an angle to the horizontal. The VIBCO device can only form asphalt driveway edges at one constant angle and does not allow the end user to form a driveway edge at any of a wide range of slope angles. Therefore, the user of the VIBCO device would have to purchase a separate vibratory edger for each edge surface slope angle that the user desires to form. Furthermore, the VIBCO device is unsuitable for compacting sloped surfaces that are more extensive than the narrow strip along the edge of a driveway.

None of the above inventions and patents, taken either singularly or in combination, is seen to describe the instant invention as claimed. In particular, none of the above references show a vibratory compacting tool that can be used to form sloped surfaces at any of a wide range of slope angles as selected by the end user of the tool. Therefore, the need persists in the art for a single vibratory tool which can be used to form sloped surfaces at any of a wide range of slope angles.

SUMMARY OF THE INVENTION

The present invention is directed to a vibratory tamping tool which is shaped for easy maneuvering and tilting so as to allow the tamping and shaping of surfaces which are sloped relative to the horizontal. The tool has a tamping surface which is longer than it is wide, and the tool's handle bar is oriented parallel to the length of the tamping surface. A motor and vibratory mechanism are supported on a platform which is spaced apart from the tamping surface. The platform is supported above the tamping surface by a web plate extending from the plate which forms the tamping surface to the platform supporting the motor and vibratory mechanism. The platform supporting the motor and vibratory mechanism, the web plate, and the plate forming the tamping surface together form the base of the tool. This base has an I-beam structure.

Accordingly, it is a principal object of the invention to provide a tamping tool that can be used to compact sloped surfaces.

It is another object of the invention to provide a tamping tool that is flexible and that can be used to form compacted surfaces at a variety of slope angles.

It is a further object of the invention to provide a tamping tool with a tamping surface that is longer than it is wide and with a handle bar that is parallel to the lengthwise dimension of the tamping surface in order to allow the tool to be easily tilted.

Still another object of the invention is to provide a tamping tool which does not have its motor or vibratory mechanism mounted to the plate which forms the tamping surface, such that the size and shape of the tamping surface will not be constrained by the need to provide for the mounting of the motor and/or vibratory mechanism.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
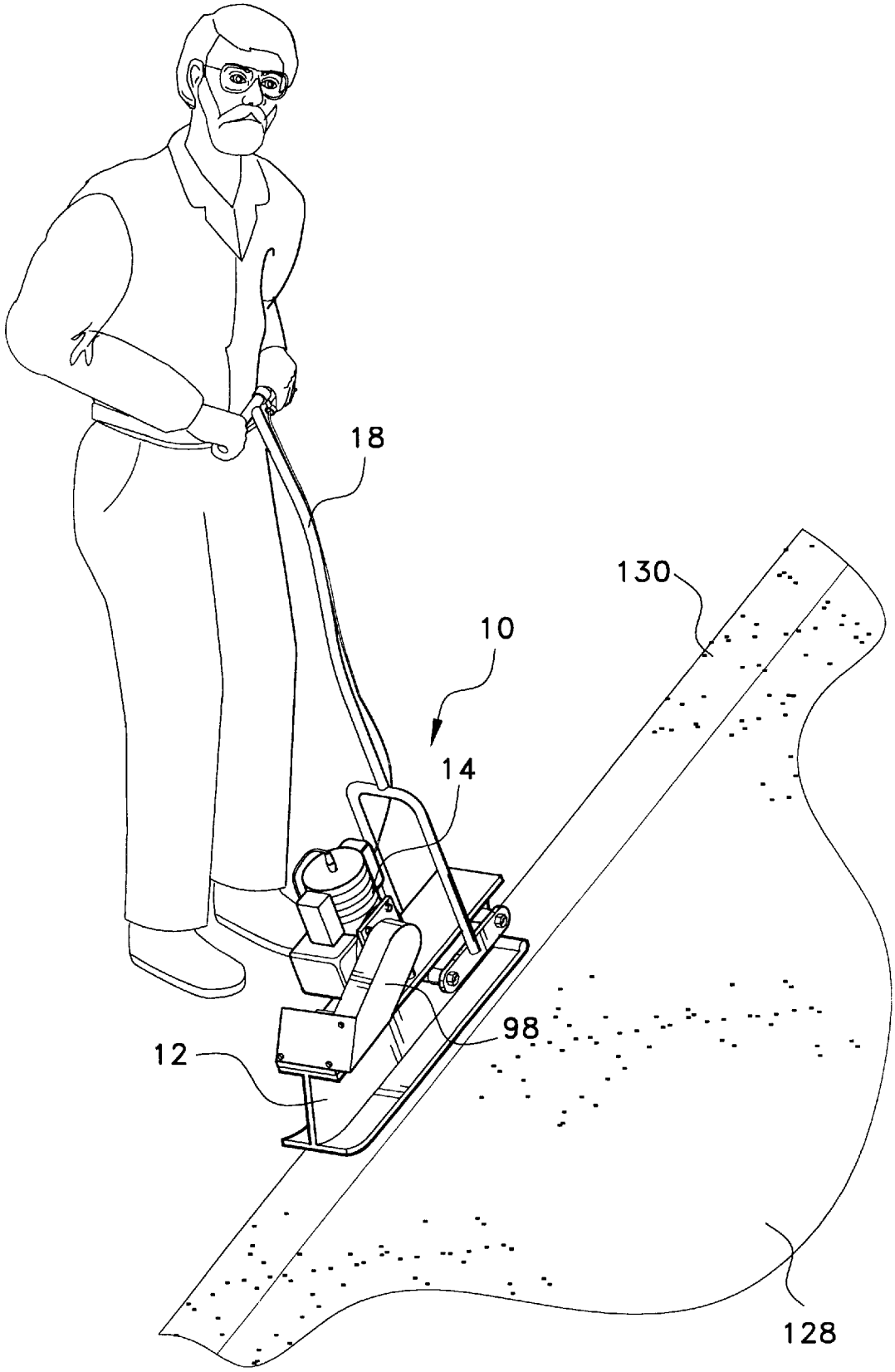
FIG. 1 is an environmental view of a vibratory tamping tool according to the present invention, being used to compact the edge of a driveway.
Figure 2:
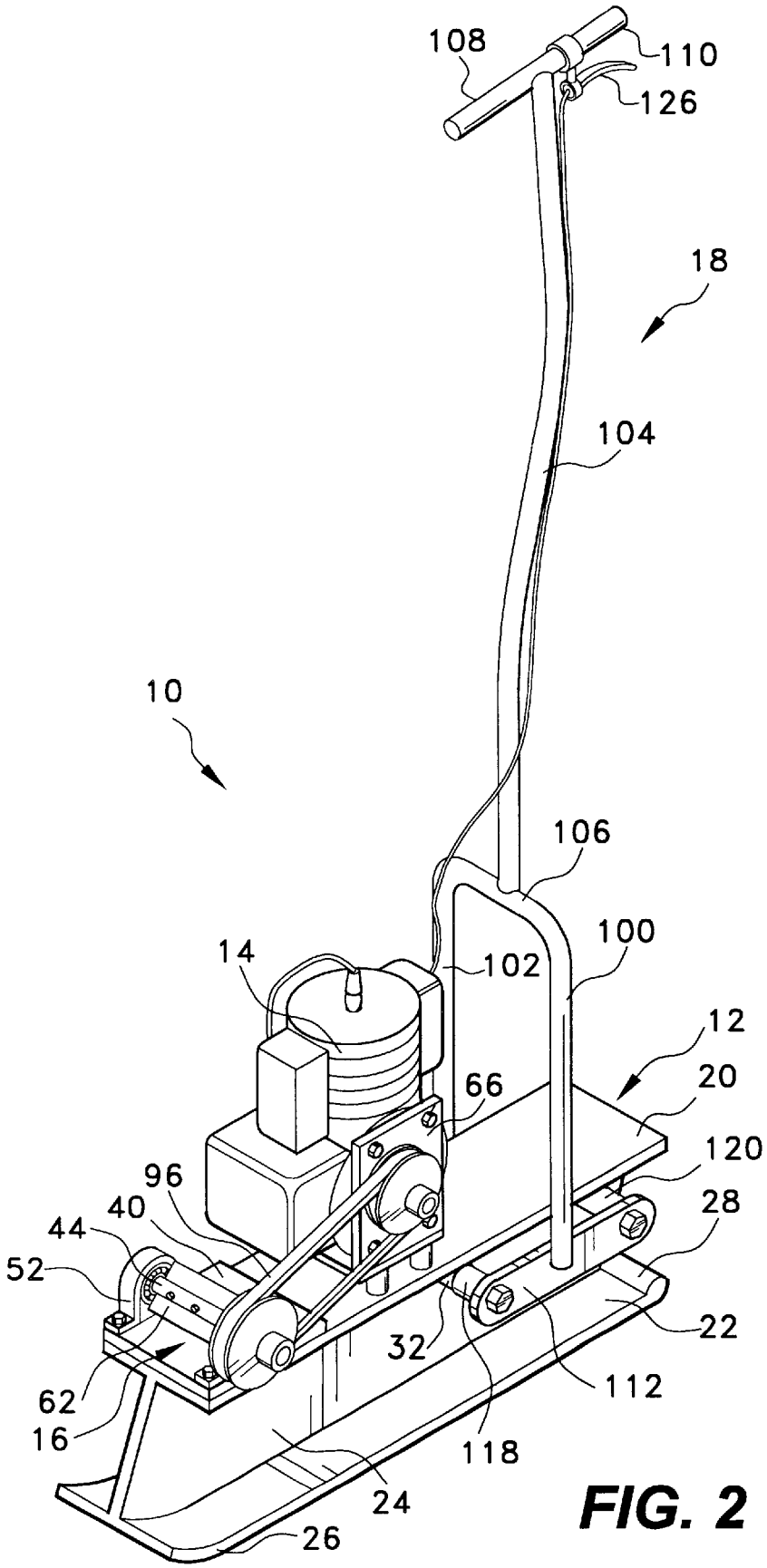
FIG. 2 is a perspective view of a vibratory tamping tool according to the present invention.

Referring to FIGS. 1–5, the present invention is directed to a vibratory tool 10 which includes a base 12, a motor 14, a vibratory means 16 for imparting vibratory movement to the base 12, and a handle 18. As shown in FIG. 2, the base 12 includes a top plate 20 and a bottom plate 22. A web plate 24 extends from the bottom plate 22 to the top plate 20 and is perpendicular to both the bottom plate 22 and the top plate 20. A portion 26 of the bottom plate 22, near the forward end of the bottom plate 22, curves toward the top plate 20. A cylindrical body 28 extends along the rearmost edge of the bottom plate 22 and gives a rounded profile to the rear edge of the bottom plate 22. The bottom surface of the bottom plate 22 forms the tamping surface of the vibratory tool 10. A pair of cylindrical sleeves 30 and 32 project from either side of the web plate 24. The bores of the cylindrical sleeves 30 and 32 define passages for the bolts 34 and 36 which secure the handle 18 to the base 12.

Figure 5:
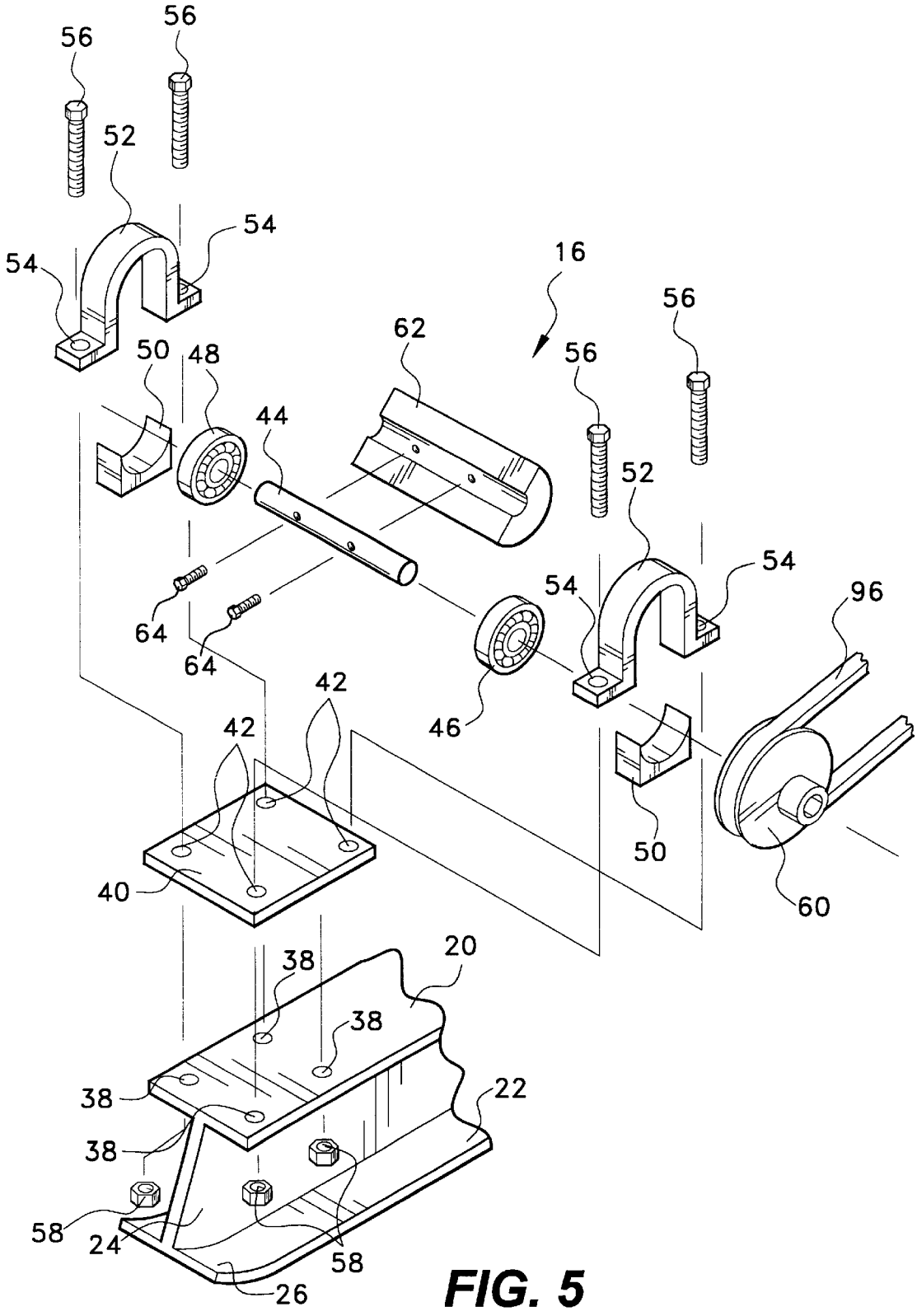
FIG. 5 is a fragmentary exploded view showing the details of the vibratory mechanism of the vibratory tamping tool according to the present invention.

Near the forward end of the top plate there are four holes 38. The four holes 38 allow the vibratory means 16 to be mounted to the top plate 20, near the forward end of the top plate 20. As shown in FIG. 5, an optional mounting plate 40 can be provided intermediate the vibratory means 16 and the top plate 20. The mounting plate 40 has four holes 42 that register with the holes 38 in the top plate 20. The thickness of the mounting plate 40 can be varied to adjust the distribution of mass along the length of the base 12.

Referring now to FIG. 5, the vibratory means 16 includes a shaft 44 rotatably supported by two ball bearing sets 46 and 48. Each ball bearing set includes an inner race, an outer race, a cage, and a plurality of ball bearings. Each of the ball bearing sets 46 and 48 is cooperatively held in place by a respective bearing seat 50 and a respective U-bracket 52. Each U-bracket 52 has a pair of holes 54, one at each end, that register with a respective pair of the holes 38. Bolts 56 are placed through the holes 54 at the ends of the U-brackets 52. The bolts 56 also pass through the holes 42 in the mounting plate 40 and the holes 38 in the top plate 20. Each of the bolts 56 is secured in place by a respective nut 58. The nuts 58 and the bolts 56 cooperatively secure the two ball bearing sets 46 and 48 to the base 12. This arrangement allows the shaft 44 to be mounted to the base 12 while allowing for the free rotation of the shaft 44. One end of the shaft 44 projects beyond the ball bearing set 46 and has a pulley 60 fixedly attached thereto such that the shaft 44 and the pulley 60 rotate as a unit.

An eccentric weight 62, which in this case is a section of a cylindrical sleeve that can fit around the shaft 44, is fixed to the shaft 44 by the screws 64. The eccentric weight 62 is positioned intermediate the ball bearing sets 46 and 48. As the shaft 44 and the eccentric weight 62 rotate together, the shaft 44 and the eccentric weight 62 form an unbalanced rotating mass which imparts vibratory motion to the base 12.

Figure 4:
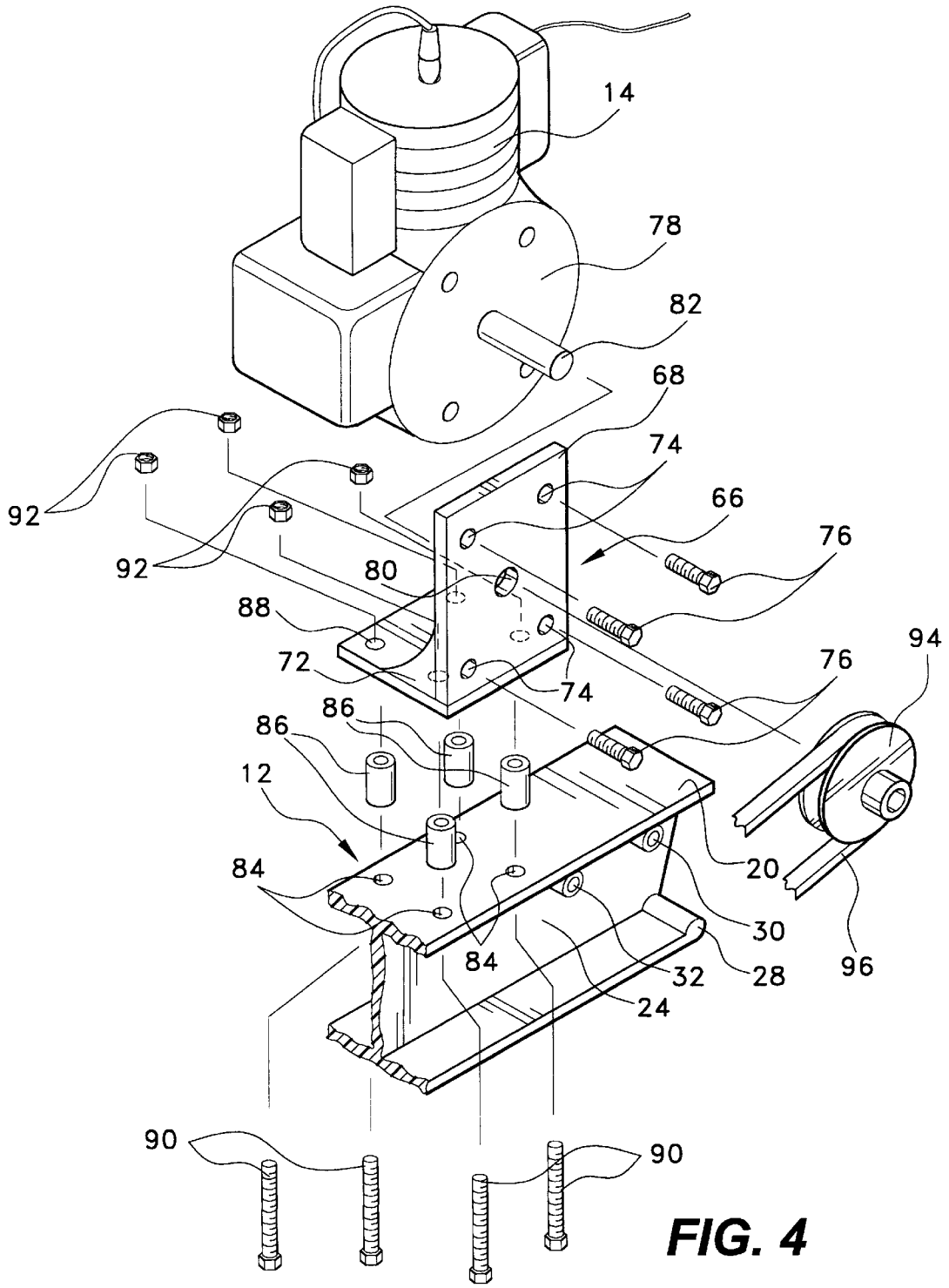
FIG. 4 is a fragmentary exploded view showing the details of the mounting of the motor of the vibratory tamping tool according to the present invention.

As seen in FIG. 4, also mounted to the base 12 is the engine or motor 14 which in the illustrated example is of the gasoline powered variety. However, an electric motor can also be used to power the rotation of the shaft 44 without departing from the spirit and scope of the present invention. In the illustrated example, the motor 14 is a small gasoline powered two-cycle engine of the type commonly used to power lawn mowers. The motor 14 is mounted to the base 12 using a mounting bracket 66. The mounting bracket 66 is formed by two plates 68 and 70 which are joined together at a right angle, for example, by welding the plates 68 and 70 together. The joint between the plates 68 and 70 may be reinforced by gussets 72 on either side of the mounting bracket 66. The first plate 68 has four holes 74 that allow the bolts 76 to pass therethrough. The bolts 76 engage the crank case 78 of the engine 14 and secure the engine 14 to the first plate 68. In addition, the first plate 68 has a hole 80 that allows the output shaft 82 of the motor 14 to pass therethrough and project outward from the first plate 68. The projecting portion of the output shaft 82 is located on the same side of the vibratory tool 10 as the first pulley 60.

The second plate 70 has four holes 88 that register with four holes 84 formed in the top plate 20. Four cylindrical rubber bushings 86 are placed between the second plate 70 and the top plate 20 of the base 12. Each cylindrical bushing 86 has a central bore that is in registry with a respective hole 88 in the second plate 70 and a respective hole 84 in the top plate 20. Each of the bolts 90 passes through a respective hole 88 in the second plate 70, a respective rubber bushing 86, and a respective hole 84 in the top plate 20 and engages a respective one of the nuts 92. Thus, the bolts 90 and the nuts 92 cooperatively secure the motor 14 to the top plate 20 of the base 12. The rubber bushings 86 provide a measure of isolation for the motor 14 from the vibrations of the base 12 and help reduce the severity of the vibrations imparted to the motor 14 by the vibrating base 12.

A second pulley 94 is fixedly attached to the output shaft 82 of the motor 14, such that the pulley 94 rotates with the output shaft 82 of the motor 14. An endless belt 96 is frictionally engaged to both the pulleys 60 and 94. As the motor 14 runs, the output shaft 82 rotates causing the pulley 94 to rotate. The rotation of the pulley 94 is imparted to the pulley 60 via the belt 96, thus causing the shaft 44 to rotate. Because of the presence of the eccentric weight 62, rotation of the shaft 44 causes vibrations which are imparted to the base 12. These vibrations provide the tamping action of the bottom plate 22 on the supporting surface below. Although a belt drive system has been used in the illustrated example, a chain and sprocket system, a shaft drive system, or a toothed belt and pulley system can also be used to transmit rotational motion from the motor output shaft 82 to the eccentric weight 62. A protective cover or guard 98 covers the power transmission system of the vibratory tool 10 so as to reduce the likelihood that foreign objects will get caught in the power transmission system and cause damage to the vibratory tool 10.

Figure 3:
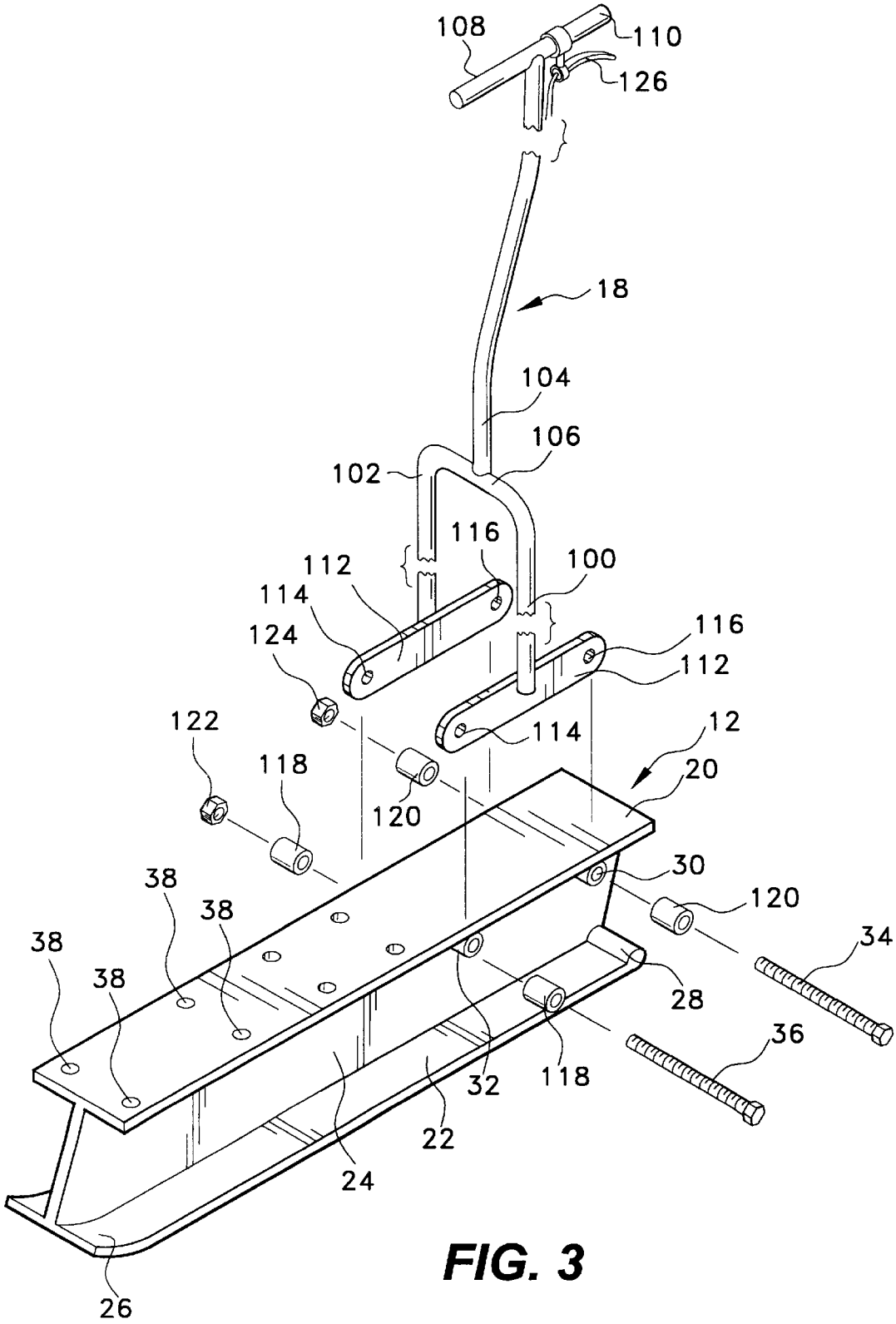
FIG. 3 is a fragmentary exploded view showing the details of the attachment of the handle of the vibratory tamping tool according to the present invention.

Referring to FIG. 3, the handle 18 has two limbs 100 and 102 that straddle the top plate 20. The handle shaft 104 forms a T-connection with a middle bar portion 106 which extends between the two limbs 100 and 102. The other end of the handle shaft 104 forms a T-connection to a handle bar 108 which is approximately parallel to the longitudinal axis of the top plate 20. The handle bar 108 is provided with soft rubber, neoprene, or plastic grips 110 at each end which afford a comfortable grip to the user. The handle shaft 104 is slightly cranked and has two bends. The portion of the handle shaft 104 extending between the two bends is canted relative to the vertical, while the portions of the handle shaft 104 at each end of the handle shaft 104 extend in directions that are more nearly vertical. At the end of each of the limbs 100 and 102, distal from the handle shaft 104, is a flat plate 112 which has two holes 114 and 116. With the limbs 100 and 102 straddling the top plate 20, each of the holes 114 registers with the bore of a respective cylindrical sleeve 32 and each of the holes 116 registers with the bore of a respective cylindrical sleeve 30. Intermediate each hole 114 and the respective cylindrical sleeve 32 is a cylindrical rubber bushing 118. The bore of each cylindrical rubber bushing 118 is in registry with the cylindrical sleeves 32. Intermediate each hole 116 and the respective cylindrical sleeve 30 is a cylindrical rubber bushing 120. The bore of each cylindrical rubber bushing 120 is in registry with the cylindrical sleeves 30. Only one each of the cylindrical sleeves 30 and 32 have been shown, because the other cylindrical sleeves 30 and 32 are simply mirror images of the ones shown in the accompanying illustrations.

A first bolt 36 is positioned to extend through the holes 114, the bushings 118, and the sleeves 32, and the bolt 36 is engaged to a nut 122. Similarly, a second bolt 34 is positioned to extend through the holes 116, the bushings 120, and the sleeves 30, and the bolt 34 is engaged to a nut 124. The bolts 34 and 36 and the nuts 122 and 124 cooperatively secure the handle 18 to the base 12. The rubber bushings 118 and 120 provide some measure of vibration isolation to the handle bar 108, thus allowing the user to grip the handle bar 108 with less battering from the vibrating tool 10.

A lever 126 is provided on the handle bar 108. The lever 126 operates the throttle which forms part of the carburetor (not shown). With the lever 126 released, the motor 14 will run at idle RPM. When the lever 126 is gripped by the operator and pivoted toward the grip 110, the motor RPM, i.e. the rotational speed of the crank shaft, will increase resulting in a more forceful vibratory motion of the vibratory tool 10. The operator can set the severity of the vibratory motion of the vibratory tool 10 at any desired level by adjusting his or her grip on the lever 126. Furthermore, using the lever 126 the operator can maintain the motor RPM at such a level that will allow the operator to remain in control of the vibratory tool 10. If the user accidentally loses his or her grip, the lever 126 will be released and the motor 14 will automatically return to idle RPM. Other safety devices, such as a kill switch, may also be provided for the vibratory tool 10. Also, the motor 14 is well known and is not described in detail herein.

The use of the vibratory tool 10 will be described in the context of tamping the edges of an asphalt driveway 128, however, it must be born in mind that the presentation of this example of the operation of the vibratory tool 10 is not intended to be limiting as to the variety of the uses of the present invention. In use, the user normally stands to the side of the asphalt driveway 128 facing the edge 130, of the asphalt driveway, which is to be tamped. The user grasps the handle bar 108 with the motor running such that the longitudinal axis of the handle bar 108 and the longitudinal axis of the bottom plate 22 are parallel to the edge 130 that is to be tamped, and such that the bottom surface of the bottom plate 22 rests on the edge 130 which is to be tamped. The vibratory movement of the base 12 repetitively pounds the surface under the bottom plate 22.

The user can hold the bottom plate 22 at any desired angle by tilting the vibratory tool 10 relative to the vertical. The angle to which the vibratory tool 10 is tilted is simply a function of how far the user stands from the base 12 and of how close to his or her body the user holds the handle bar 108. By tamping the driveway edge 130 with the bottom plate 22 held at an angle relative to the horizontal, a driveway edge 130 that is banked or angled relative to the horizontal can be obtained. The bottom plate 22 is usually several times longer than it is wide to allow for easy tilting of the vibratory tool 10, while the bottom plate 22 longitudinally extends along the edge being tamped. For example, the bottom plate 22 may have a length that is two to eight times its width. The width of the bottom plate 22 is generally of the same order as the desired width for the banked edge 130 of the driveway. In practice, the bottom plate 22 may be from three to twelve inches wide. By separating the plate to which the motor 14 and vibratory mechanism 16 are mounted from the plate that is actually used to tamp the asphalt or concrete, the plate that is used for tamping can be made in a desired size and shape which is best suited to the particular tamping task at hand.

It is to be understood that the present invention is not limited to the embodiment described above, but encompasses any and all embodiments within the scope of the following claims.

I claim:

1. A vibratory tamping tool comprising:

(a) a base having an elongate top plate, an elongate bottom plate, and an elongate web plate normal to and joined to the top plate and the bottom plate by welding, the bottom plate defining a tamping surface, the top plate having a top surface;

(b) a vibratory mechanism having:

(i) a pair of journal bearings mounted in parallel spaced relation on the top surface of the top plate of said base;

(ii) a shaft rotatably mounted in the journal bearings; and (iii) an eccentric weight fixedly attached to the shaft between the journal bearings;

(c) a motor mounted on the top surface of the top plate of said base, said motor being coupled to the shaft of said vibratory mechanism; and (d) a handle attached to said base in order to allow a user to guide and control the vibratory tamping tool;

wherein rotation of the shaft of said vibratory mechanism causes said base to vibrate, separation of the top plate and the bottom plate by the web plate permitting the tamping surface to have an area independent of a surface area required to mount said vibratory mechanism and said motor, and permitting the tamping surface to be tilted relative to horizontal in order to tamp a surface at an angle.

2. The vibratory tamping tool according to claim 1, wherein said motor has an output shaft, the vibratory tamping tool further comprising:

a first pulley fixed to said output shaft;

a second pulley fixed to said vibratory mechanism shaft; and an endless belt frictionally engaging both said first pulley and said second pulley, whereby rotation of said output shaft causes the rotation of said vibratory mechanism shaft.

3. The vibratory tamping tool according to claim 2, wherein said top plate has a first plurality of holes, the vibratory tamping tool further comprising:

a mounting bracket having a first mounting bracket plate, said first mounting bracket plate having a second plurality of holes, each of said second plurality of holes being in registry with a respective one of said first plurality of holes, said motor being attached to said mounting bracket;

a first plurality of resilient bushings positioned intermediate said first mounting bracket plate and said top plate of said base, each of said first plurality of resilient bushings having a bore which is in registry with a respective one of said first plurality of holes and with a respective one of said second plurality of holes;

a first plurality of bolts each having a shaft positioned to extend through a respective one of said first plurality of holes, through a respective one of said first plurality of resilient bushings, and through a respective one of said second plurality of holes; and a first plurality of nuts each being engaged to a respective one of said first plurality of bolts to thereby secure said first plurality of bolts in place, whereby jolts imparted to said motor due to vibratory movement of said base are reduced in severity by said first plurality of resilient bushings.

4. The vibratory tamping tool according to claim 3, wherein said base has two transverse passages and said handle comprises:

a first handle mounting plate positioned on a first side of said base, said first handle mounting plate having a first hole and a second hole;

a second handle mounting plate positioned on a second side of said base, said second handle mounting plate having a first hole and a second hole, said first hole of said second handle mounting plate being in registry with a first one of said two transverse passages and with said first hole of said first handle mounting plate, said second hole of said second handle mounting plate being in registry with a second one of said two transverse passages and with said second hole of said first handle mounting plate;

a first limb fixed to said first handle mounting plate;

a second limb fixed to said second handle mounting plate, said second limb being essentially parallel to said first limb;

a middle bar portion extending from said first limb to said second limb;

a handle shaft having a first end and a second end, said first end of said handle shaft being fixed to said middle bar portion to form a T-connection;

a handle bar fixed to said second end of said handle shaft to form a T-connection;

a second plurality of resilient bushings, a first one of said second plurality of resilient bushings being positioned intermediate said first hole of said first handle mounting plate and said first one of said two transverse passages, a second one of said second plurality of resilient bushings being positioned intermediate said first hole of said second handle mounting plate and said first one of said two transverse passages, a third one of said second plurality of resilient bushings being positioned intermediate said second hole of said first handle mounting plate and said second one of said two transverse passages, and a fourth one of said second plurality of resilient bushings being positioned intermediate said second hole of said second handle mounting plate and said second one of said two transverse passages, each of said second plurality of resilient bushings having a bore which is in registry with a respective one of said two transverse passages;

a first handle attachment bolt having a shaft positioned to extend through said first hole of said first handle mounting plate, said first one of said second plurality of resilient bushings, said first one of said two transverse passages, said second one of said second plurality of resilient bushings, and said first hole of said second handle mounting plate;

a second handle attachment bolt having a shaft positioned to extend through said second hole of said first handle mounting plate, said third one of said second plurality of resilient bushings, said second one of said two transverse passages, said fourth one of said second plurality of resilient bushings, and said second hole of said second handle mounting plate; and a pair of handle attachment nuts each engaging a respective one of said first handle attachment bolt and said second handle attachment bolt to thereby secure said first handle attachment bolt and said second handle attachment bolt in place.

5. The vibratory tamping tool according to claim 1, wherein said bottom plate has a length and a width, said length of said bottom plate being at least twice said width of said bottom plate, wherein said bottom plate has a longitudinal axis parallel to said length thereof, and wherein said handle includes a handle bar having a longitudinal axis which is parallel to said longitudinal axis of said bottom plate.

* * * * *